United States Patent [19]

Gahlinger

[11] Patent Number: 4,512,810

[45] Date of Patent: Apr. 23, 1985

[54] BOLSTER PIN AND METHOD FOR CLEANING FLASK BUSHING

[75] Inventor: Earl C. Gahlinger, Ekron, Ky.

[73] Assignee: International Harvester Company, Chicago, Ill.

[21] Appl. No.: 572,090

[22] Filed: Jan. 18, 1984

[51] Int. Cl.[3] ..... B08B 1/00

[52] U.S. Cl. ..... 134/8; 15/164; 15/206; 134/42; 164/158; 249/205; 425/226

[58] Field of Search ..... 134/8, 42; 15/164, 206; 164/158; 249/205; 425/225, 226; 403/13, 14

[56] References Cited

U.S. PATENT DOCUMENTS

| | | | |
|---|---|---|---|
| 360,012 | 3/1887 | Guntz | 164/158 |
| 1,206,273 | 11/1916 | Veeck et al. | 15/164 X |
| 2,272,419 | 2/1942 | Meyer | 15/164 X |
| 2,814,083 | 11/1957 | Beyer | 164/158 |
| 3,133,298 | 5/1964 | Norwood | 15/164 |
| 4,140,171 | 2/1979 | Michelson | 164/158 |
| 4,169,299 | 10/1979 | Bandoh | 164/158 X |
| 4,386,868 | 6/1983 | Bluver et al. | 249/205 X |

*Primary Examiner*—Marc L. Caroff

*Attorney, Agent, or Firm*—Ernest E. Helms; F. David AuBuchon

[57] ABSTRACT

A bolster pin is provided which automatically cleans the flask bushing of a mold set. The bolster pin has brushing elements which clean the flask bushing each time the mold set is joined or separated. Use of the bolster pin provides a method for automatically cleaning the flask flange bushing of entrapped sand.

22 Claims, 3 Drawing Figures

60
8
62
64
42

50
8
52
56
54
42

2
16
48
6
14
8
10
42
12
20
24
44
4
46
18
38
32
38
28
36
34
26
30

BOLSTER PIN AND METHOD FOR CLEANING FLASK BUSHING

BACKGROUND OF THE INVENTION

Field of the Invention

The present invention relates to an improved method and apparatus for cleaning the flask bushing of a flask and bolster mold set. More specifically, this invention relates to a bolster pin which provides alignment of the bolster and flask, while at the same time providing an apparatus for automatically cleaning the flask flange bushing.

Castings are produced by filling a cavity with a molten substance which later solidifies, taking on the shape of the cavity. One method of preparing the cavity is to utilize a 2-part sand box commonly referred to as a bolster and flask. The bolster is generally in the shape of a rectangular box. Bolted to the bolster top is a plate with the pattern. The pattern is used to make an impression on the sand to form the desired cavity. Mounted on top of the pattern and bolster is the flask. The flask is an essentially rectangular box without a bottom or top which is fitted over the bolster. Sand is dropped through the top of the flask. After the flask is filled with sand, the sand is compressed over the pattern causing the sand to form a cavity in the desired pattern shape. The flask is then removed. The sand in the flask with the impressed pattern is matched with the other half of the casting mold. The flask which has the top portion of the casting impression is the cope flask. The flask which has the bottom portion of the casting impression is the drag flask. The drag and cope flask flanges are joined together and the sand is prepared for pouring of the casting.

To facilitate the joining and separating, the bolster and flask are both provided with flanges. To insure proper alignment between the bolster and flask there is provided on the bolster flange a pin commonly referred to as the bolster pin. To minimize replacement costs, the flask flange bore is often fitted with a bushing which may be replaced when worn.

When the sand is dropped into the flask, often there is spillage over the top of the flask and into the flask flange bushing. The above spillage is difficult to prevent due to time requirements in performing the casting operation.

The entrapped sand in the flask flange bushing becomes wedged in between the bolster pin and the flask flange bushing. After a while, joining and separation of the bolster and flange will become more difficult and will require more time and energy.

Prior to the present invention, clogging of the flask flange bushing was remedied by using human labor to ream out the clogging materials. Also during the time of cleaning, the flask set was placed out of service.

SUMMARY OF THE INVENTION

The present invention overcomes the various problems of the prior method. The present invention includes the use of a bolster pin which not only aligns the flask flange to the bolster flange, but automatically cleanses the flask flange bushing. The new bolster pin has a base portion similar to prior bolster pins but also has a brush for cleaning the flask flange bushing. By joining or separating the bolster and flask, the flask flange bushing is automatically cleaned.

An object of the present invention is to provide an improved method of cleaning flask flange bushings.

Another object of the present invention is to reduce the effort and time required for joining and separating the bolster and flask, by preventing clogging of sand in the flask bushing. Another object of the present invention is to eliminate the labor associated with cleaning the flask flange bushing. Another object of the present invention is to prolong bolster pin and flask bushing life by keeping abrasive sand out of the bushing. Another object of the present invention is to provide a partial seal to prevent sand spillage from entering the flask bushing. Another object of the present invention is to eliminate the downtime for cleaning of flask flange bushings. It is still another object of the present invention to reduce the cost associated with cleaning of the flask flange bushing. It is yet another object of the present invention to continually maintain operational alignment of the bolster and flask by continually cleaning the flask flange bushing. These and other objects of the present invention may be appreciated by consideration of the drawings and detailed description.

DETAILED DESCRIPTION OF THE DRAWINGS

Figure 1:
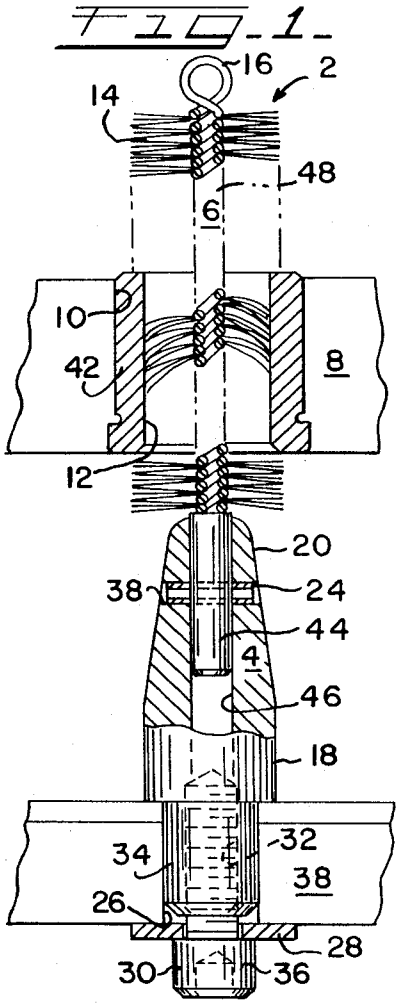
FIG. 1 is a side elevational view of an embodiment of the present invention wherein the elongated member is mounted within an axial bore of the base portion.

FIG. 1 is a side elevational view of an embodiment of the present invention. The bolster pin 2 is comprised of three major elements. The first element of the bolster pin is the base portion 4. The base portion 4 is adapted for attachement to the bolster flange 38. Bolster pin 2 also has an elongated element 6 which is attached to the base portion 4 and projects generally axially from the base portion 4. Projecting radially outward from the elongated element 6 are brush elements 14. Brush elements 14 are adapted to make cleaning contact with the bore of the flask flange. As will be really understood by those familiar with the industry, flash flange bore 10 in nost instances will have inserted therein a hardened steel bushing 42. Bushing 42 will provide the bore 12 for the flash pin alignment. The term "flask flange bore," as used in this application, will also refer to the interior surface of a bushing when so applicable and the present invention may be used with or without flask flange bushings.

To aid in attaching the base portion 4 to the bolster flange, 38 there is provided stud 34. Stud 34 is integrally joined to the base portion 4 opposite the elongated element 6 and is adapted for insertion into bore 26 of bolster flange 38.

In the embodiment illustrated in FIG. 1, the elongated member 6, base portion 4 and stud 34 have a circular cross-sectional area and are coaxial with one another. Base portion 4 is made of nose section 20 and plug section 18. Nose section 20 is shaped generally as a cone or paraboloid integrally joined with plug 18 along the nose's conical base. The nose 20 is shaped to guide the flask flange 8 into alignment with the bolster flange.

The plug 18 generally is shaped as a cylinder and provides alignment when the flask flange 8 is lowered.

The stud 34 is generally shaped like a cylinder. The largest diameter of stud 34 is less than the diameter of the most adjacent part of base portion 4, plug 18.

As illustrated in FIG. 1, the pin retaining bolt 36 is threadably inserted into stud 34 to aid in attaching boltster pin 4 to the bolster flange 38. Retaining nut 36 has a head 30 which presses against washer 28. If desired, washer 28 may be eliminated by using a bolt head 30 which has a larger diameter than that of bore 26.

Elongated element 6 is made up of lower elongated member 44 and an upper elongated member 48. The upper elongated member 48 as illustrated in FIG. 1 is a tightly wound cylindrical coil which captures the brush elements 14. Axial bore 46 is provided on base portion 4 for mounting the elongated element 6 within the base portion 4. Transverse to axial bore 46 is bore 38. Transverse bore 38 intersects with axial bore 46. Transverse bore 38 is also aligned with and coterminous with a transverse bore in the lower elongated member 44. A dowel pin 24 is retained within transverse bore 38 for attaching the elongated element 6 to the base portion 4. Upper elongated member 48 at its end has an eyelet 16 to facilitate transporting the bolster pin 2. Eyelet 16 is also used for removal of the elongated member 6 from bore 46 for brush element change after the dowel pin 24 has been removed.

Figure 2:
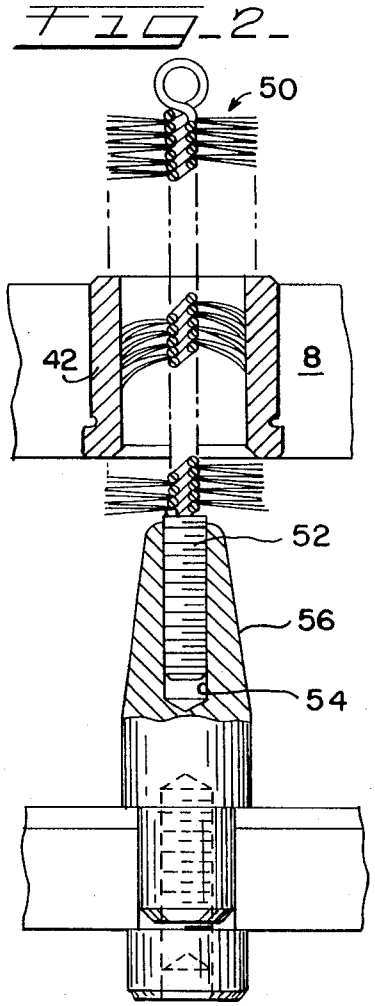
FIG. 2 is a side elevational view of an embodiment of the present invention wherein the elongated member is threadably mounted within an axial bore of the base portion.

FIG. 2 is a side elevational view of an embodiment of the present invention wherein the bolster pin 50 has an elongated member 52 threadably mounted within the axial bore 54 of base portion 56.

Figure 3:
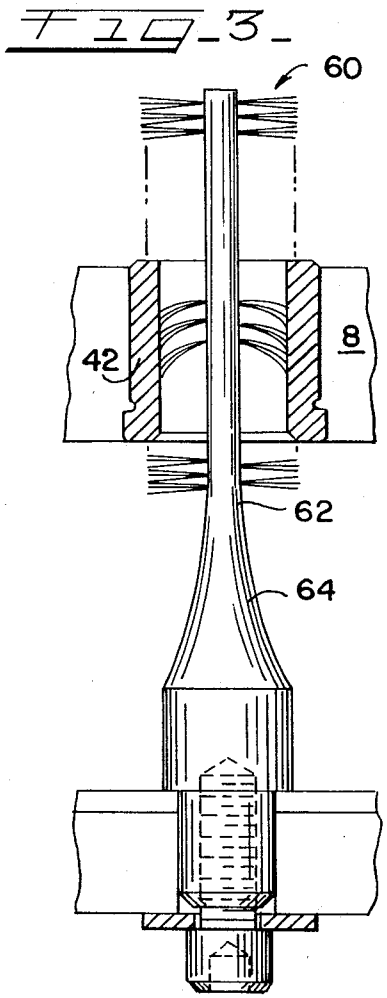
FIG. 3 is a side elevational view of another embodiment of the present invention.

FIG. 3 is a side elevational view of another embodiment of the present invention. Bolster pin 60 has an elongated member 62 integrally connected to the base portion 64.

In operation the bolster pin 2 is attached to the bolster flange 38 by threadably inserting the retainer bolt 36 into threaded bore 32. The flask flange bore 12 is then aligned with bolster pin 2. The flask flange 8 is then joined with the bolster flange 38. The brush elements 14 then brush the flask flange bore 12 as brush elements 14 move relative to the flask flange bore 12. The cleaning action is repeated as the flask flange 8 and bolster flange 38 are separated.

In addition to the above, after joining of the flask flange 8 to the bolster flange 38 the brush elements 14 act to seal the flask flange bore 12 from spillage of sand by covering the flask flange bore 12. The operation of the bolster pins 50 and 60 is substantially the same as explained for bolster pin 2.

It will be apparent to those skilled in the art that the present invention may be utilized in the joining and separating of cope and drag flask flanges and therefore, a repetition of the previous description is unnecessary.

While the apparatus and working of the present invention has been explained in the various embodiments illustrated in FIGS. 1, 2 and 3, it will be apparent to those skilled in the art of the various modifications which can be made without departing from the spirit or scope of the present invention as encompassed by the following claims.

What is claimed is:

1. A mold set including a flask flange with a bore, bolster flange, and a bolster pin, said bolster pin comprising:

a base portion having a shape which aligns with the bore in said flask flange and attached to said bolster flange;

an elongated element, attached to said base portion generally projecting axially from said base portion; and brush elements generally projecting radially outward from said elongated element sized to make cleaning contact with the bore in said flask flange.

2. An apparatus as recited in claim 1 wherein said base portion has a circular cross section.

3. An apparatus as recited in claim 2 wherein said base portion has a plug section generally shaped like a cylinder and a nose generally shaped as a cone integrally joined to said plug section on said nose's conical base, and said nose being adjacent to said elongated element.

4. An apparatus as recited in claim 1 wherein a stud is integrally attached to said base portion opposite said elongated element and said stud being capable of insertion into a bore of said bolster flange.

5. An apparatus as recited in claim 1 wherein said elongated element has an eyelet at said elongated element end opposite said base portion.

6. An apparatus as recited in claim 4 wherein said stud is generally shaped as a cylinder.

7. An apparatus as recited in claim 4 wherein said stud has a generally axial threaded bore and said bolster pin also has a pin retaining nut threadably inserted into said stud for attachment of said bolster pin to the bolster flange.

8. An apparatus as recited in claim 4 wherein said stud has a smaller diameter than the diameter of said base portion immediately adjacent to said stud.

9. An apparatus as recited in claim 4 wherein said base portion, stud, and elongated element are axially aligned.

10. An apparatus as recited in claim 9 wherein said base portion, stud and elongated element have circular cross sections.

11. An apparatus as recited in claim 1 wherein said base portion has a generally axial bore, said elongated element is mounted within said bore.

12. An apparatus as recited in claim 11 wherein said elongated element is threadably mounted within said axial bore of said base portion.

13. An apparatus as recited in claim 11 wherein said base portion has a transverse bore which intersects with the axial bore of said base portion, said elongated member having a transverse bore which generally aligns with said transverse bore of said base portion and a dowel pin is retained within said transverse bores.

14. An apparatus as recited in claim 1 wherein said elongated element is integrally atached to said base portion.

15. A flask flange bolster pin for aligning a mold set of a bolster flange and a flask flange, and for cleaning a bore in the flask flange comprising:

a base portion, having a shape which aligns with the bore in said flask flange, said base portion having a generally cylindrical plug section and a nose generally shaped like a cone integrally joined to said plug on said nose's conical base;

a stud shaped generally like a cylinder, said stud being integrally connected to said plug and being coaxially aligned with said plug, and said stud having a diameter less than the diameter of said plug, and said stud having a axial threaded bore;

a pin retaining bolt threadably inserted into said axial bore of said stud, said pin retaining bolt providing attachment of said bolster pin to said bolster flange;

an elongated element, attached to said base portion adjacent said nose, said elongated element being coaxial with said base portion; and brush elements generally projecting radially outward from said elongated element sized to make cleaning contact with the bore in said flash flange.

16. A flask flange bolster pin for aligning a mold set of a bolster flange and a flask flange, and for cleaning a bore in the flask flange comprising:

a base portion, having a shape which aligns with the bore in said flask flange said base portion having a generally cylindrical plug section and a nose generally shaped like a cone integrally joined to said plug on said nose's conical base and said base portion having a generally axial bore and a transverse bore intersecting said axial bore;

a stud shaped generally like a cylinder, said stud being integrally connected to said plug and being coaxially aligned with said plug, and said stud having a diameter less than the diameter of said plug, and said stud having a axial threaded bore;

a pin retaining bolt threadably inserted into said axial bore of said stud, said pin retaining bolt providing attachment of said bolster pin to said bolster flange;

an elongated element mounted with said axial bore of said base portion opposite said stud, and said elongated element having a transverse bore which aligns with said transverse bore of said base portion said elongated element being attached to said base portion by a dowel pin retained in said transverse bores; and brush elements generally projecting radially outward from said elongated element sized to make cleaning contact with the bore in said flask flange.

17. A mold set including a first flask flange with a bore and a second flask flange, and an alignment pin, said alignment pin comprising:

a base portion having a shape which aligns with the bore in the first flask flange and attached to said second flask flange;

an elongated element, attached to said base portion generally projecting axially from said base portion; and brush elements generally projecting radially outward from said elongated element sized to make cleaning contact with a bore in the first flask flange.

18. A method of cleaning the bore in the flask flange of a mold set of flask with a bore and bolster with a bolster pin comprising:

attaching a bolster pin to a bolster flange, said bolster pin having a base portion adjacent to the bolster and an elongated member projecting towards the flask flange, said elongated member having brush elements generally projecting radially outward from said elongated element;

aligning the bore in the flask flange with said bolster pin;

joining the flask flange and the bolster flange; and brushing the flask flange bore as said bolster pin brush elements move relative to the flask bore.

19. A method as recited in claim 18 with the additional process of:

separating the flask flange and bolster flange; and brushing the flask flange bore as said brush elements move relative to the flask bore.

20. A method as recited in claim 18 wherein attaching the bolster pin to the bolster flange comprises threadably inserting a retainer bolt into a threaded bore in said bolster pin.

21. A method as recited in claim 18 with the additional process of sealing the flask flange bore by covering the flask flange bore with said brush elements.

22. A method of cleaning the bore in the first flask flange of a mold set of a first flask with a bore and a second flask with a cleaning pin comprising:

attaching a cleaning pin to a second flask flange, said cleaning pin having a base portion adjacent to the second flask and an elongated member projecting towards the first flask flange, said elongated member having brush elements generally projecting radially outward from said elongated element;

aligning the bore in the first flask flange with said cleaning pin;

joining the first flask flange and the second flask flange; and brushing the first flask flange bore as said cleaning pin brush elements move relative to the first flask bore.

* * * * *